US008081909B2

(12) United States Patent
Nishiwaki et al.

(10) Patent No.: US 8,081,909 B2
(45) Date of Patent: Dec. 20, 2011

(54) IMAGE FORMING DEVICE HAVING DEVELOPING MATERIAL CASE AND A VIBRATOR FOR VIBRATING CARRYING ELECTRODES AND CONTROLLER FOR CHANGING THE FREQUENCY OF VIBRATION

(75) Inventors: Kenjiro Nishiwaki, Aichi (JP); Tomoaki Hattori, Aichi (JP)

(73) Assignee: Brother Kogyo Kabushiki Kaisha, Aichi (JP)

( * ) Notice: Subject to any disclaimer, the term of this patent is extended or adjusted under 35 U.S.C. 154(b) by 397 days.

(21) Appl. No.: 12/235,165

(22) Filed: Sep. 22, 2008

(65) Prior Publication Data

US 2009/0080941 A1 Mar. 26, 2009

(30) Foreign Application Priority Data

Sep. 26, 2007 (JP) ..... 2007-249006

(51) Int. Cl.
*G03G 15/08* (2006.01)

(52) U.S. Cl. ..... 399/261; 399/295

(58) Field of Classification Search ..... 399/222, 399/258, 261, 289–295
See application file for complete search history.

(56) References Cited

U.S. PATENT DOCUMENTS

| | | | | |
|---|---|---|---|---|
| 4,418,643 | A * | 12/1983 | Barto et al. | 399/261 |
| 4,527,884 | A * | 7/1985 | Nusser | 399/266 |
| 4,558,941 | A * | 12/1985 | Nosaki et al. | 399/266 |
| 6,215,974 | B1 * | 4/2001 | Katoh et al. | 399/258 |
| 2003/0175052 | A1 * | 9/2003 | Adachi et al. | 399/265 |
| 2006/0210320 | A1 * | 9/2006 | Nakagawa et al. | 399/265 |

FOREIGN PATENT DOCUMENTS

JP 61-73167 4/1986

* cited by examiner

*Primary Examiner* — David Gray
*Assistant Examiner* — G. M. Hyder
(74) *Attorney, Agent, or Firm* — Scully, Scott, Murphy & Presser, PC

(57) ABSTRACT

There is provided an image forming device, comprising: an image holding unit configured to hold an image formed by developing material; a developing material case configured to accommodate the developing material and to have a supplying opening facing the image holding unit; a carrying unit having a plurality of carrying electrodes, the carrying unit being configured to carry the developing material accommodated in the developing material case toward the image holding unit by generating a traveling electric field through the plurality of carrying electrodes; a vibrator that vibrates the carrying unit; and a controller that controls the vibrator to change a frequency of vibration.

9 Claims, 15 Drawing Sheets

IMAGE FORMING DEVICE HAVING DEVELOPING MATERIAL CASE AND A VIBRATOR FOR VIBRATING CARRYING ELECTRODES AND CONTROLLER FOR CHANGING THE FREQUENCY OF VIBRATION

CROSS-REFERENCE TO RELATED APPLICATION

This application claims priority under 35 U.S.C. §119 from Japanese Patent Application No. 2007-249006, filed on Sep. 26, 2007. The entire subject matter of the application is incorporated herein by reference.

BACKGROUND

1. Technical Field

Aspects of the present invention relate to an image forming device having a function of generating a traveling electric field for carrying developing material.

2. Related Art

In general, an image forming device (e.g., a printer or a multifunction peripheral) is provided with a carrying unit for carrying developing material (hereafter, referred to as a developing material carrying device) toward an image holding unit (e.g., a photosensitive drum). Image forming devices having a developing material carrying device which carries the developing material through a traveling electric field have been proposed.

In such a developing material carrying device, a carrying body having a plurality of line-like electrodes aligned in a line is provided. In the developing material carrying device, a traveling electric field is generated by successively applying a polyphase alternating voltage to the electrodes of the carrying body. As a result, charged developing material is carried.

However, such a developing material carrying device has a drawback that the developing material agglutinates on the carrying body. If such a phenomenon occurs, the developing material can not be carried smoothly.

Japanese Patent Provisional Publication No. SHO 61-73167 (hereafter, referred to as JP SHO 61-73167A) discloses an example of a developing material carrying device capable of collapsing the developing material agglutinated in the carrying body by vibrating the entire carrying body. More specifically, in the developing material carrying device, a vibrating unit is provided at a predetermined position, and the vibrating unit is controlled to produce a vibrating motion at a predetermined frequency so that the entire carrying body is vibrated.

SUMMARY

However, in the developing material carrying device, the vibration frequency of the carrying unit is fixed at the predetermined frequency. Therefore, if a condition of the developing material is changed due to variation in environmental conditions such as humidity or temperature, it becomes difficult to appropriately collapse the agglutinated developing material.

Aspects of the present invention are advantageous in that an image forming device capable of appropriately collapsing agglutinated developing material even if a condition of the developing material changes depending on variation in environmental conditions is provided.

According to an aspect of the invention, there is provided an image forming device, comprising: an image holding unit configured to hold an image formed by developing material; a developing material case configured to accommodate the developing material and to have a supplying opening facing the image holding unit; a carrying unit having a plurality of carrying electrodes, the carrying unit being configured to carry the developing material accommodated in the developing material case toward the image holding unit by generating a traveling electric field through the plurality of carrying electrodes; a vibrator that vibrates the carrying unit; and a controller that controls the vibrator to change a frequency of vibration.

Since the frequency of vibration can be changed, it is possible to appropriately collapse agglutinated developing material even if a condition of the developing material changes depending on variation in environmental conditions. That is, it is possible to appropriately collapse agglutinated developing material by vibration at a suitable frequency matching the current condition of the developing material.

It is noted that various connections are set forth between elements in the following description. It is noted that these connections in general and unless specified otherwise, may be direct or indirect and that this specification is not intended to be limiting in this respect. Aspects of the invention may be implemented in computer software as programs storable on computer-readable media including but not limited to RAMs, ROMs, flash memory, EEPROMs, CD-media, DVD-media, temporary storage, hard disk drives, floppy drives, permanent storage, and the like.

BRIEF DESCRIPTION OF THE ACCOMPANYING DRAWINGS

DETAILED DESCRIPTION

Hereafter, embodiments according to the invention will be described with reference to the accompanying drawings.

First Embodiment

Figure 1:
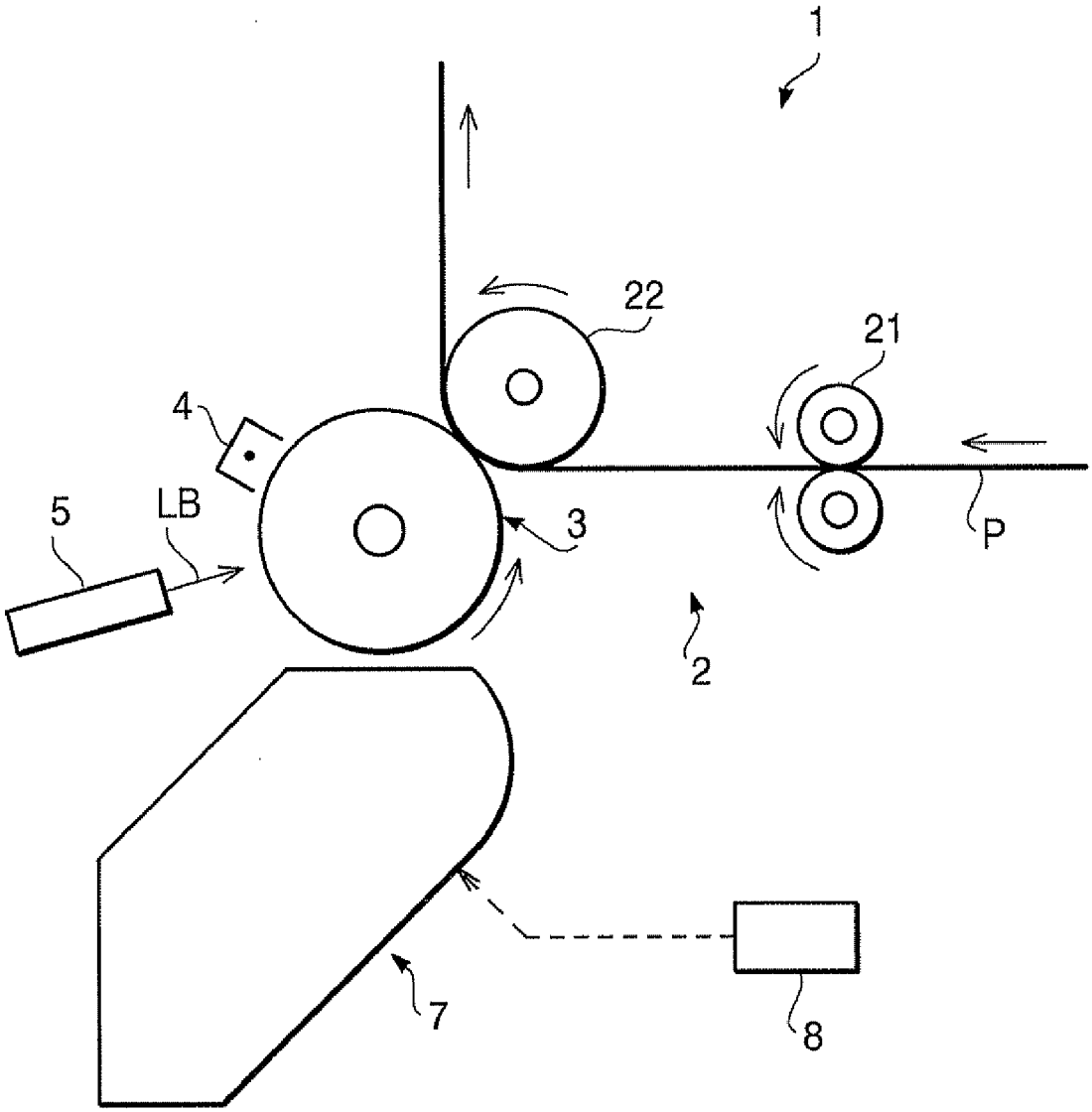
FIG. 1 is a side view illustrating a general internal configuration of a laser beam printer functioning as an image forming device according to a first embodiment.
Figure 2:
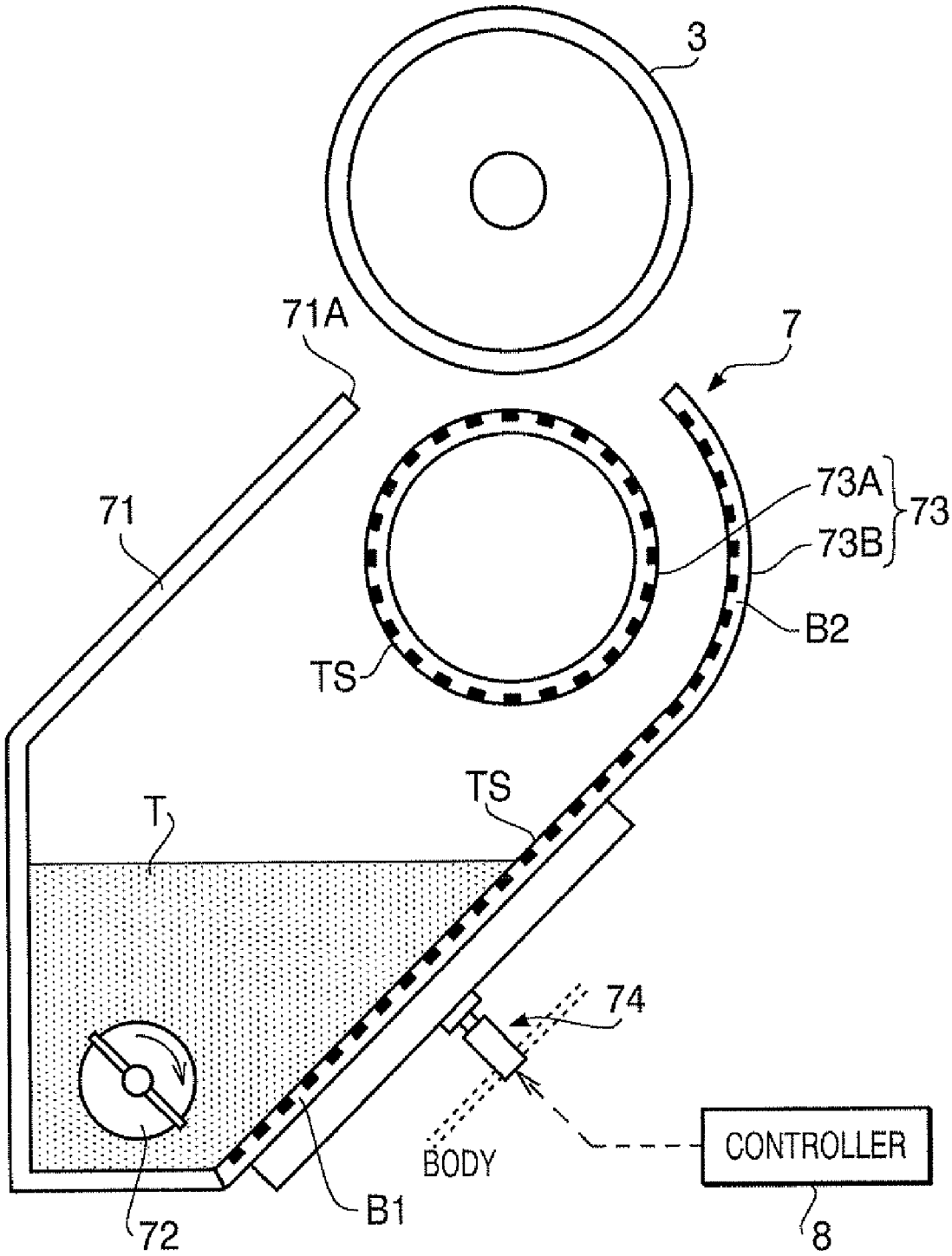
FIG. 2 is a side cross section illustrating an internal structure of a toner supplying device provided in the laser beam printer.

FIG. 1 is a side view illustrating a general internal configuration of a laser beam printer 1 functioning as an image forming device according to a first embodiment of the invention. FIG. 2 is a side cross section illustrating an internal structure of a toner supplying device 7.

As shown in FIG. 1, the laser beam printer 1 includes a paper carrying mechanism 2, a photosensitive drum 3 functioning as an image holding unit, a charger 4, a scanning unit 5, the toner supplying device 7, and a controller 8. In FIG. 1, other components, such as a paper supply tray and a fixing unit, are omitted for the sake of simplicity.

The paper carrying mechanism 2 carries a sheet of paper P supplied from the paper supply tray. The paper carrying mechanism 2 includes a plurality of rollers (e.g. a registration roller 21) for carrying the paper 2 to a transferring position of the photosensitive drum 3.

A developing process is executed as follows. After an outer circumferential surface of the photosensitive drum 3 is negatively charged by the charger 4 uniformly, the negatively charged outer circumferential surface of the photosensitive drum 3 is scanned by a high-speed scanning laser beam LB from the scanning unit 5. Since the potential of scanned part of the outer circumferential surface of the photosensitive drum 3 changes, a latent image is formed on the outer circumferential surface of the photosensitive drum 3.

Next, toner T (i.e., developing material) is supplied from the toner supplying device 7 to the latent image on the photosensitive drum 3. In other words, the toner T is supplied selectively toward the outer circumferential surface of the photosensitive drum 3. Consequently, a toner image is formed on the photosensitive drum 3.

Subsequently, the photosensitive drum 3 and a transfer roller 22 are rotated to carry the paper P while sandwiching the paper P therebetween. Since at this time the toner image held on the outer circumferential surface of the photosensitive drum 3 is attracted by the transfer roller 22, the toner image is transferred from the photosensitive drum 3 to the paper P.

As shown in FIG. 2, the toner supplying device 7 includes a cartridge case 71, an agitator 72, a toner carrying unit 73 and a vibrator 74. The cartridge case 71 is made of material having a relatively high degree of rigidity, such as resin. A part of a wall of the cartridge case 71 is formed as the toner carrying unit 73. A supply opening 71A is formed at the upper part of the cartridge case 71 to face the photosensitive drum 3. The cartridge case 71 accommodates the toner T in the bottom part thereof. The toner T is non-magnetic single-component toner having a negative electrostatic property. That is, the toner T is charged negatively. For example, the toner T is toner containing polyester as a major constituent.

The agitator 72 is provided at the deepest part in the cartridge case 71 to be rotatable to agitate the toner T accumulated in the cartridge case 71. By agitating the toner T, the toner T can be negatively charged due to, for example, friction between particles of the toner T or friction between the toner T and the toner carrying unit 73.

Figure 3A:
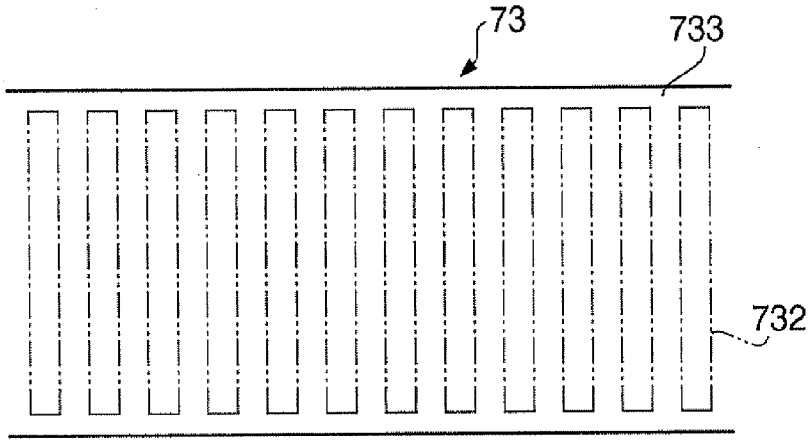
FIG. 3A is a plan view of a toner carrying unit provided in the laser beam printer.
Figure 3B:
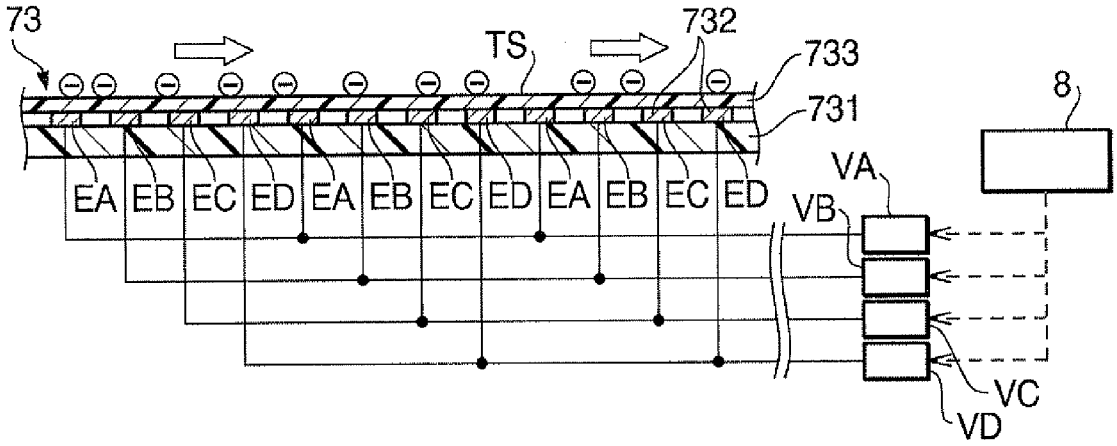
FIG. 3B is a cross section of the toner carrying unit.

FIG. 3A is a plan view of the toner carrying unit 73. FIG. 3B is a cross section of the toner carrying unit 73. As shown in FIG. 3B, the toner carrying unit 73 includes a support plate 731, a plurality of carrying electrodes 732 arranged on the support plate 731, a coating 733 which covers the support plate 731 on the side on which the carrying electrodes 732 are formed. For example, the coating 733 is a coating film made of nylon (resin). In FIG. 3B, a surface of the coating 733 is represented as a carrying surface TS on which the toner T is carried. The toner carrying unit 73 formed to be a thin plate has a lower degree of rigidity than that of the cartridge case 71 so that the toner carrying unit 73 has a property of being vibrated more easily.

As shown in FIG. 3A, each of the carrying electrodes 732 is a linear pattern made of a thin metal film extending in a direction perpendicular to a carrying direction of the toner T. In other words, each carrying electrode 732 extends in a direction of an axis of the photosensitive drum 3. The carrying electrodes 732 are arranged, at constant intervals in the carrying direction of the toner T, in parallel with each other.

The carrying electrodes 732 are connected to a first feeder VA, a second feeder VB, a third feeder VC and a fourth feeder VD which supply voltages having different phases. More specifically, the carrying electrodes 732 are connected to the first feeder VA, the second feeder VB, the third feeder VC and the fourth feeder VD repeatedly in this order from the upstream side. In other words, in the arrangement of the carrying electrodes 732, electrodes connected to the same feeder (VA, VB, VC or VD) are arranged at intervals of four electrodes as illustrated in FIG. 3B. In the following, the carrying electrodes 732 connected to the first feeder VA are referred to as "carrying electrodes EA", the carrying electrodes 732 connected to the first feeder VB are referred to as "carrying electrodes EB", the carrying electrodes 732 connected to the first feeder VC are referred to as "carrying electrodes EC", and the carrying electrodes 732 connected to the first feeder VD are referred to as "carrying electrodes ED" for the sake of convenience.

Figure 4:
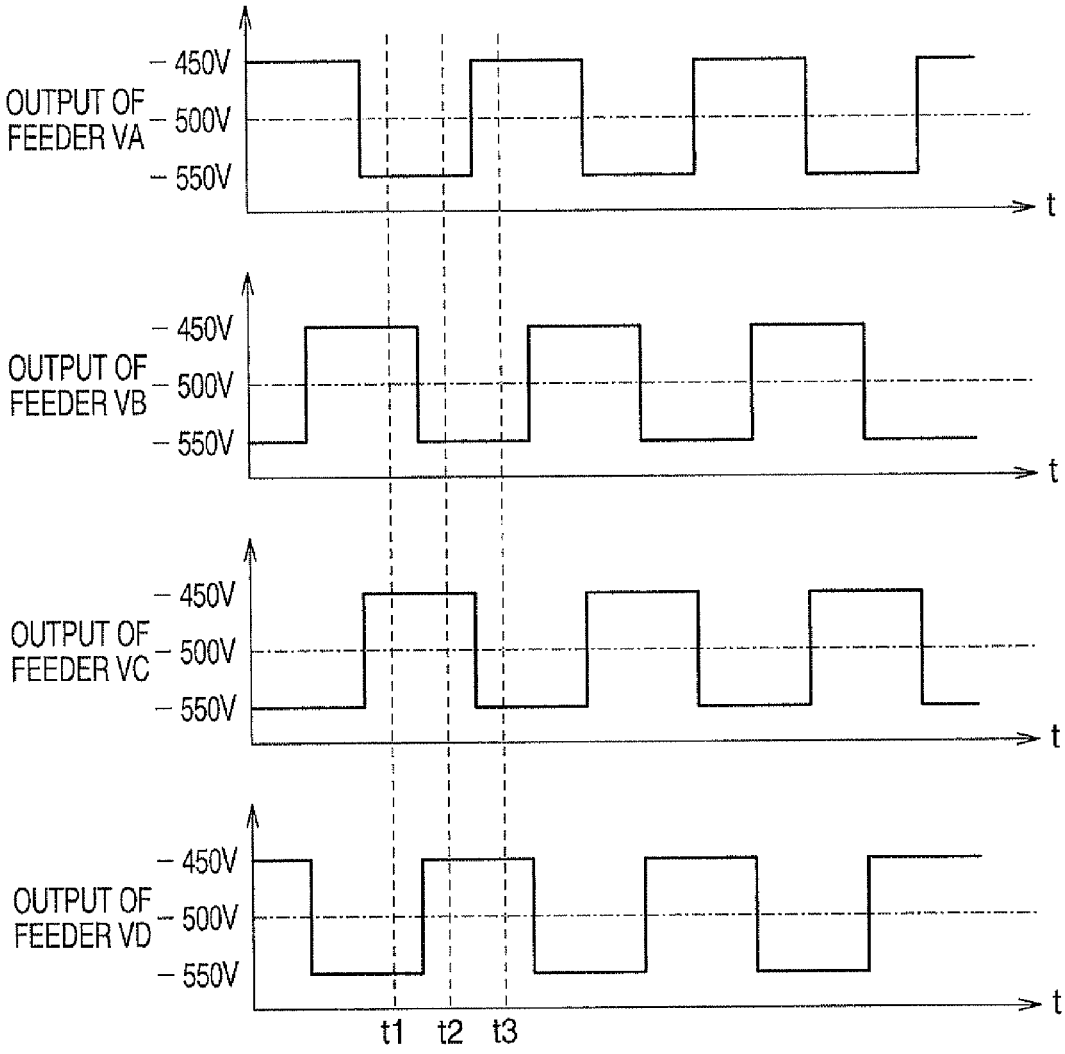
FIG. 4 illustrates waveforms output by four types of feeders.

FIG. 4 illustrates waveforms of output voltages of the first to fourth feeders VA, VB, VC and VD, respectively. Under control of the controller 8, the first to fourth feeders VA, VB, VC and VD respectively outputs the voltages shown in FIG. 4. More specifically, the waveforms of the output voltages of the feeders VA, VB, VC and VD have the same shape, but phases of the waveforms are shifted with respect to each other at intervals of 90 degrees. By thus applying the waveforms from the first to fourth feeders VA, VB, VC and VD to the carrying electrodes 732, a traveling voltage can be applied to the carrying electrodes 732. Consequently, a traveling electric field can be generated on the carrying surface TS.

Figure 6A:
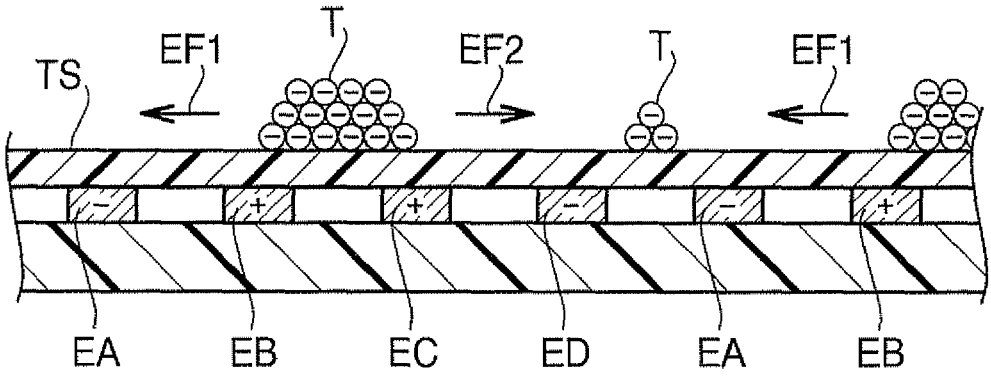
FIG. 6A illustrates condition of toner being carried on a carrying surface at time t1.

In the following, the voltage of −550V is represented as a negative voltage with respect to the intermediate voltage of −500V and the voltage of −450V is represented as a positive voltage with respect to the intermediate voltage of −500V. As shown in FIG. 4, at the time t1, the negative voltage is output from each of the first and fourth feeders VA and VD and the positive voltage is output from each of the second and third feeders VB and VC. FIG. 6A illustrates the condition of the toner T on the carrying surface TS at the time t1.

As shown in FIG. 6A, an electric field EF1 having a direction (indicated by an arrow EF1) opposite to the carrying direction of the toner T is generated between the negative carrying electrode EA and the positive carrying electrode EB, and an electric field EF2 having a direction (indicated by an arrow EF2) equal to the carrying direction of the toner T is generated between the positive carrying electrode EC and the negative carrying electrode ED. In this case, a large amount of negative toner T is collected around the positive carrying electrodes EB and EC, and a small amount of toner T which was not able to move to the positive carrying electrodes EB and DC remains between the negative carrying electrodes ED and EA.

Figure 6B:
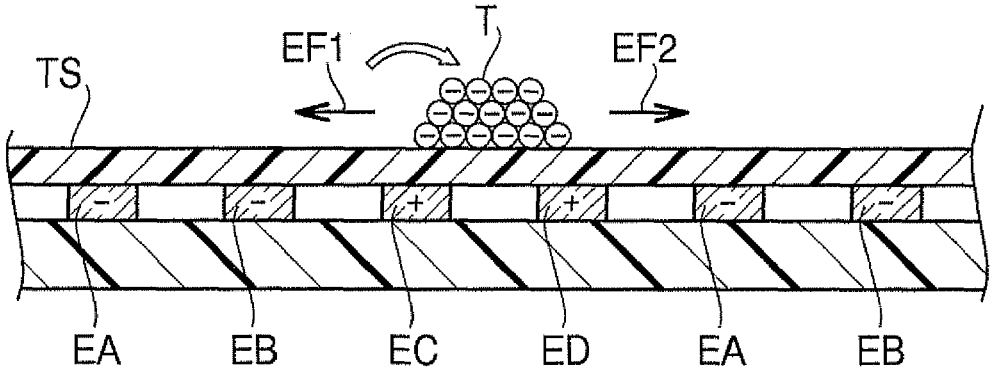
FIG. 6B illustrates condition of toner being carried on the carrying surface at time t2.

As shown in FIG. 4, at the time t2, the negative voltage is output from each of the first and second feeders VA and VB, and the positive voltage is output from each of the third and fourth feeders VC and VD. FIG. 6B illustrates the condition of the toner T on the carrying surface TS at the time t2. As shown in FIG. 6B, since the electric field EF1 is generated between the negative carrying electrode EB and the positive carrying electrode EC, the toner T which was situated around the carrying electrodes EB and EC at the time t1 moves to the carrying electrodes EC and ED which are now in a positive voltage state.

Figure 6C:
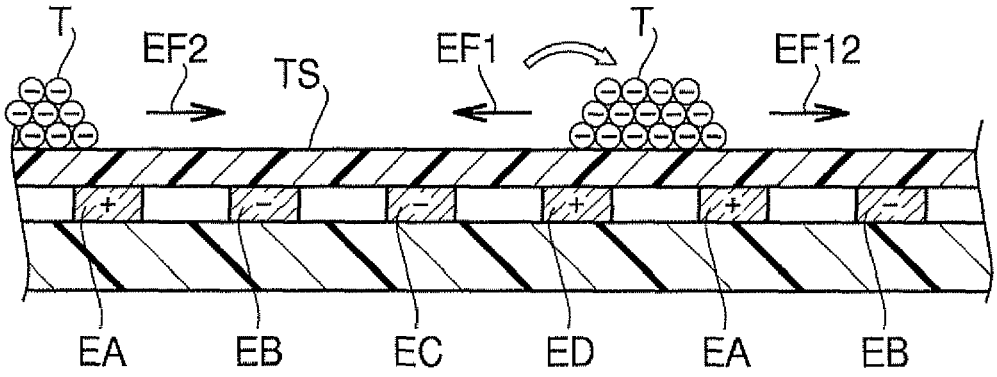
FIG. 6C illustrates condition of toner being carried on the carrying surface at time t3.

FIG. 6C illustrates the condition of the toner T on the carrying surface TS at the time t3. As shown in FIG. 6C, the electric field EF1 is generated between the negative carrying electrode EC and the positive carrying electrode ED. Therefore, the toner T which was situated around the carrying electrodes EC and ED at the time t2 moves to the carrying electrodes ED and EA which are now in a positive voltage state. By repeating the above described voltage controls shown in FIGS. 6A, 6B and 6C, the toner T is carried along the carrying surface TS.

As shown in FIG. 2, the toner carrying unit 73 includes a first carrying unit 73A which is provided in the cartridge case 71 and has a form of a cylinder, and a second carrying unit 73B having a shape of a curved plate to form a part of the wall of the cartridge case 71. More specifically, the second carrying unit 73B includes a tilting part B1 which extends, in a slanting direction, upwardly from the bottom of the cartridge case 71, and a cylindrical part B2 which is formed to face the first carrying unit 73A and to form the supply opening 71A at the top edge thereof. In the toner carrying unit 73 configured as above, the toner T accumulated in the bottom part of the cartridge case 71 is carried upwardly in a slanting direction along the tilting part B1 of the second carrying unit 73B, and then is carried between the first carrying unit 73A and the cylindrical part 32 of the second carrying unit 73B toward the photosensitive drum 3.

If a latent image is formed on the photosensitive drum 3, the toner T which has moved to the supply opening 71A is attracted by the latent image on the photosensitive drum 3 and thereby moves to the photosensitive drum 3. On the other hand, if no latent image formed on the photosensitive drum 3, the toner T passes by the photosensitive drum 3 and thereby is carried successively along the first carrying unit 73A until the voltage supply to the first carrying unit is terminated.

Figure 5A:
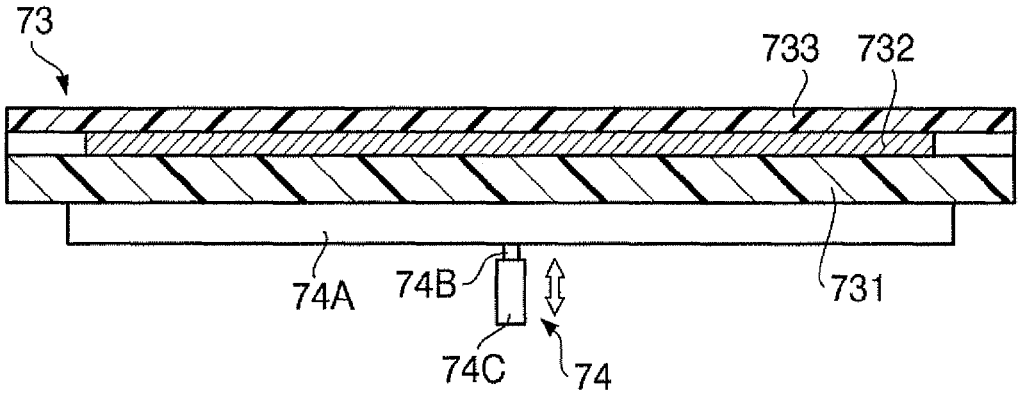
FIG. 5A is a front view illustrating a configuration of a vibrator provided in the laser beam printer.

FIG. 5A is a front view illustrating a configuration of the vibrator 74. The vibrator 74 includes a plate-like member 74A having substantially the same size as that of the titling part B1 of the toner carrying unit 73, a coil 74B fixed at the center of the plate-like member 74A, and a core 74C which vibrates the coil 74B in an axial direction of the core 74C.

The plate-like member 74A is made of material having a higher degree of rigidity than that of the toner carrying unit 73. The plate-like member 74A has a width larger than or equal to the length of the carrying electrode 732 in the longitudinal direction. Such a configuration makes it possible to appropriately collapse the toner T agglutinated on the carrying electrodes 732.

Figure 5B:
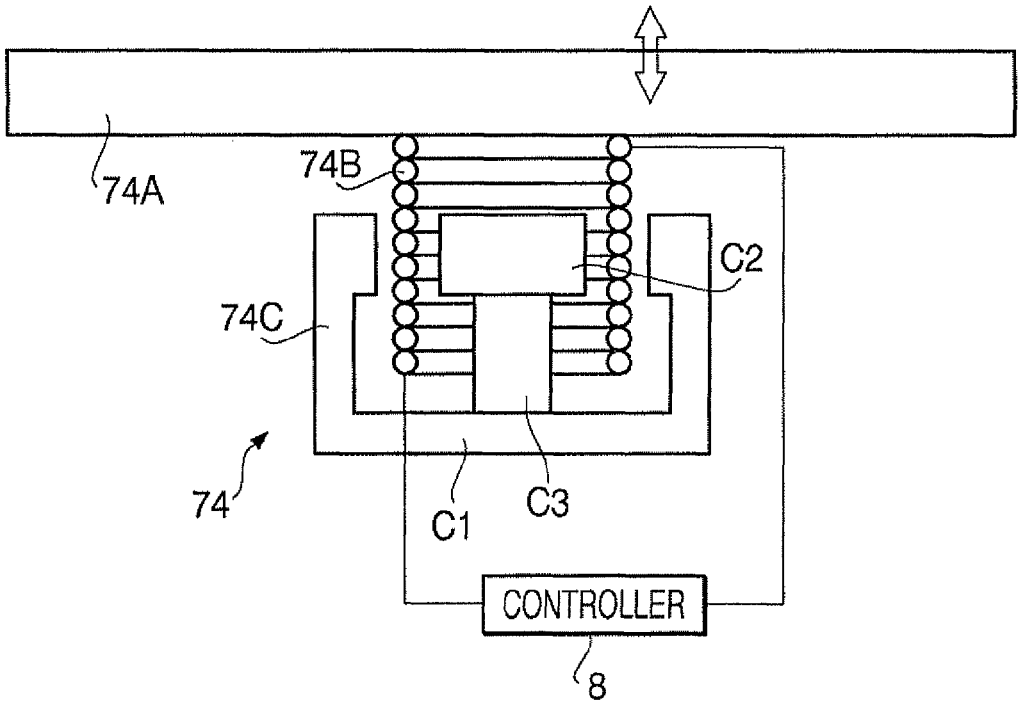
FIG. 5B is a cross section illustrating in detail the configuration of the vibrator.

FIG. 5B is a cross section illustrating in detail the configuration of the vibrator 74. As shown in FIG. 74, the coil 74B is arranged such that one end of the coil 74B is fixed to the plate-like member 74A and the other end of the coil 74B is situated in the inside of the core 74C. By supplying an alternating voltage from the controller 8 to the coil 74B, positive and negative voltages having the same amplitude can be applied alternately to the coil 74B. Consequently, the coil 74B generates an alternating magnetic field.

The core 74C includes a cylinder-shaped outer core part C1 having a bottom surface, an inner core part C2 located in the outer core part C1 to have a gap with respect to the outer core part C1, and a permanent magnet part C3 provided between the bottom surface of the outer core part C 1 and the inner core part C2. The core 74C configured as above is able to generate a magnetic field from the gap.

With this configuration, when an alternating voltage is applied to the coil 74B situated in the magnetic field, the coil 74B receives an alternating force in the axial direction by Fleming's left-hand rule. Consequently, the coil 74B vibrates with respect to the core 74C.

Figure 7:
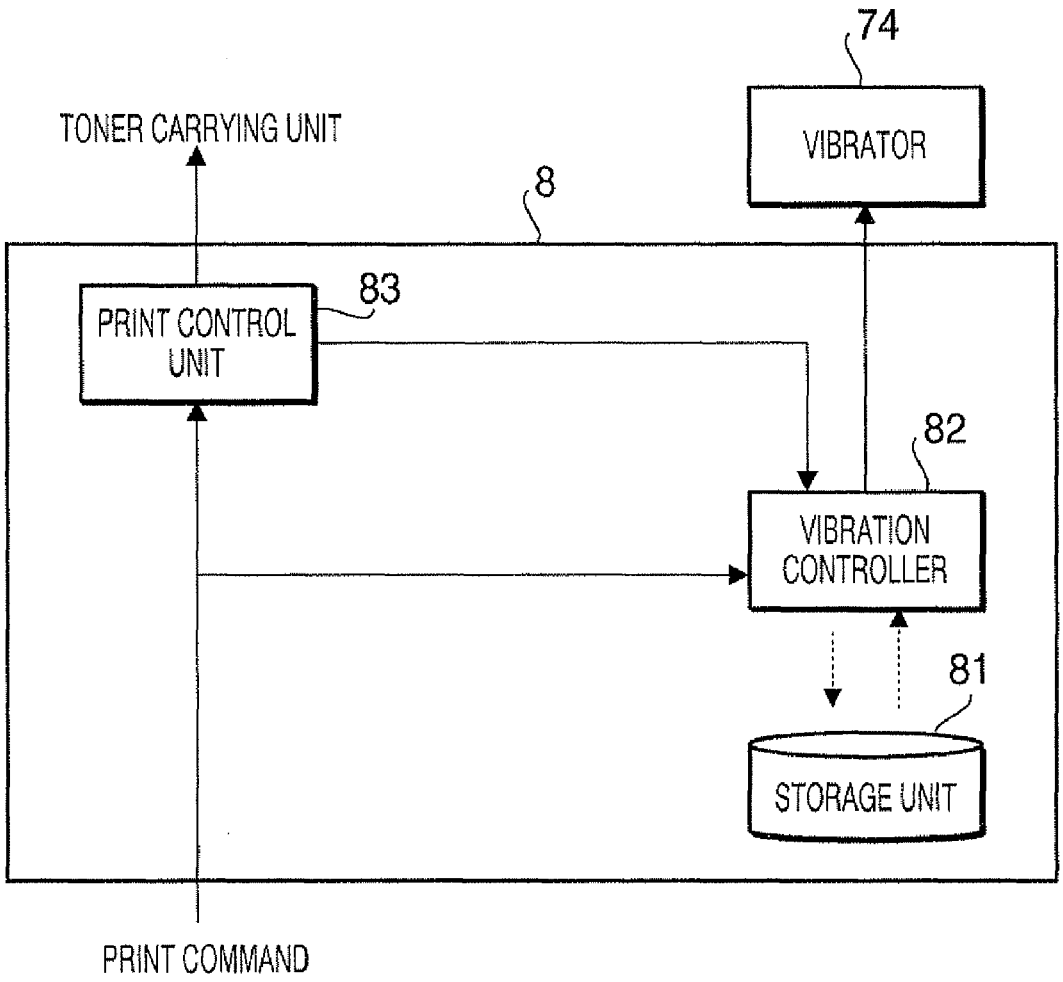
FIG. 7 is a block diagram of a controller according to the first embodiment.

Hereafter, the controller 8 is explained. FIG. 7 is a block diagram of the controller 8. The controller 8 may be a microcomputer chip in which a CPU, a ROM and a RAM are embedded. The controller 8 controls the various internal components in the laser beam printer 1. The controller 8 also has the function of producing an up-and-down motion of the vibration frequency of the vibrator 74 within a predetermined range.

Figure 8:
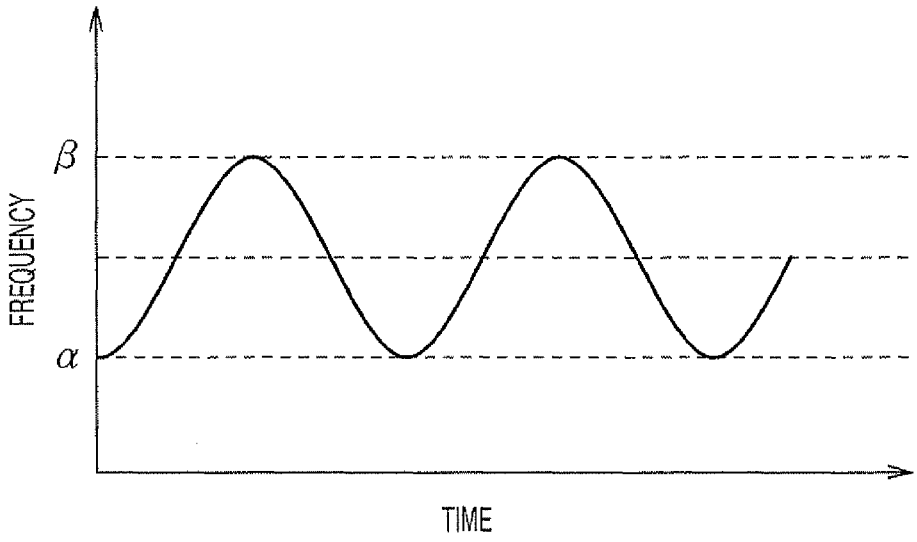
FIG. 8 is a graph illustrating control of vibration frequency executed by the controller.

More specifically, the controller 8 includes a storage unit 81, a vibration controller 82 and a print control unit 83. The storage unit 81 stores a program for controlling the vibration frequency to produce the up-and-down motion in a form of a sine wave between the frequencies $\alpha$ and $\beta$ as illustrated in FIG. 8. For example, the fluctuation range "$\alpha$ to $\beta$" of the frequency is a range between 50 and 1000 Hz. A range between 100 and 500 Hz is more suitable. For example, a period of the sine wave shown in FIG. 8 is 100 ms.

Although in this embodiment the program for continuously and periodically changing the vibration frequency is adopted, a program for changing up and down the vibration frequency within a predetermined range such that the vibration frequency takes discrete values may be adopted.

As shown in FIG. 7, when receiving a print command, the vibration controller 82 loads the above described program from the storage unit 81 on the RAM to execute the program. By executing the program, the vibration controller 82 executes the function of vibrating the vibrator 74 while changing continuously the frequency. The print command may be inputted to the vibration controller 82 through an operation panel provided on the outer surface of the laser beam printer 1. Alternatively, the print command may be inputted to the vibration controller 82 from an external computer connected to the laser beam printer 1. The print command may be accompanied by various types of information, such as setting of the number of copies.

When the vibration controller 82 starts the vibration of the vibrator 74, the vibration controller 82 sends the print command to the print control unit 83. On the other hand, when the vibration controller 82 receives a print completion signal from the print control unit 83, the vibration controller 82 stops the vibration of the vibrator 74.

When the print control unit 83 receives the print command from the vibration controller 82, the print control unit 83 executes a print operation in accordance with the received print command. More specifically, the print control unit 83 executes the print operation while controlling various internal components including the toner carrying unit 73 in the laser beam printer 1. When the printing operation for the number of copies designated in the print command is finished, the print control unit 83 sends the print completion signal to the vibration controller 82.

Figure 9:
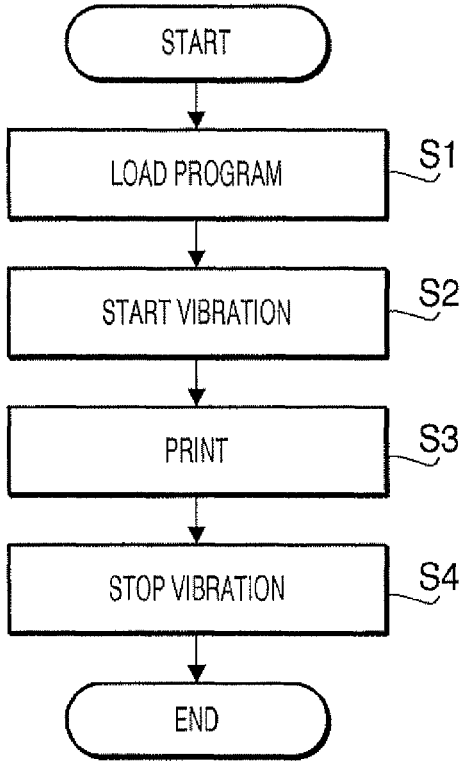
FIG. 9 is a flowchart illustrating a control process executed under control of the controller according to the first embodiment.

FIG. 9 is a flowchart illustrating a control process executed under control of the controller 8 according to the first embodiment. When the controller 8 receives the print command from a user, the controller loads the program from the storage unit 81 to the RAM (step S1). Next, the controller 8 applies an alternating voltage to the vibrator 74 so that the vibration frequency of the vibrator 74 changes continuously (step S2).

After step S2 is processed, the controller 8 executes the print operation (step S3). After the print operation for the number of copies designated in the print command is finished, the controller 8 stops to apply the alternating voltage to the vibrator 74 so that the vibration of the vibrator 74 is stopped (step S4). Then, the process shown in FIG. 9 terminates.

According to the first embodiment, the following advantages are achieved. Since the controller 8 changes the vibration frequency of the vibrator up and down within the predetermined range of frequency, it is possible to collapse the agglutinated toner T at an optimum frequency defined depending on current environmental condition. In other words, even if the environmental condition changes and there by the suitable frequency for collapsing the toner T changes, the controller 8 is able to suitably collapse the toner T at an optimum frequency for collapsing the toner T.

Since the up-and-down motion of the frequency is performed during the carrying motion of the toner T, it is possible to effectively fluidize the toner T at an optimum frequency in comparison with the case where the up-and-down motion of the vibration frequency is not performed during the carrying motion of the toner T.

Second Embodiment

Hereafter, a laser beam printer according to a second embodiment is described. A laser beam printer according to the second embodiment is a variation of the laser beam printer 1 achieved by changing a partial structure around the toner supplying device 7. Therefore, in FIGS. 10 and 11, to elements which are substantially the same as those of the first embodiment, the same reference numbers are assigned, and explanations thereof will not be repeated.

Figure 10:
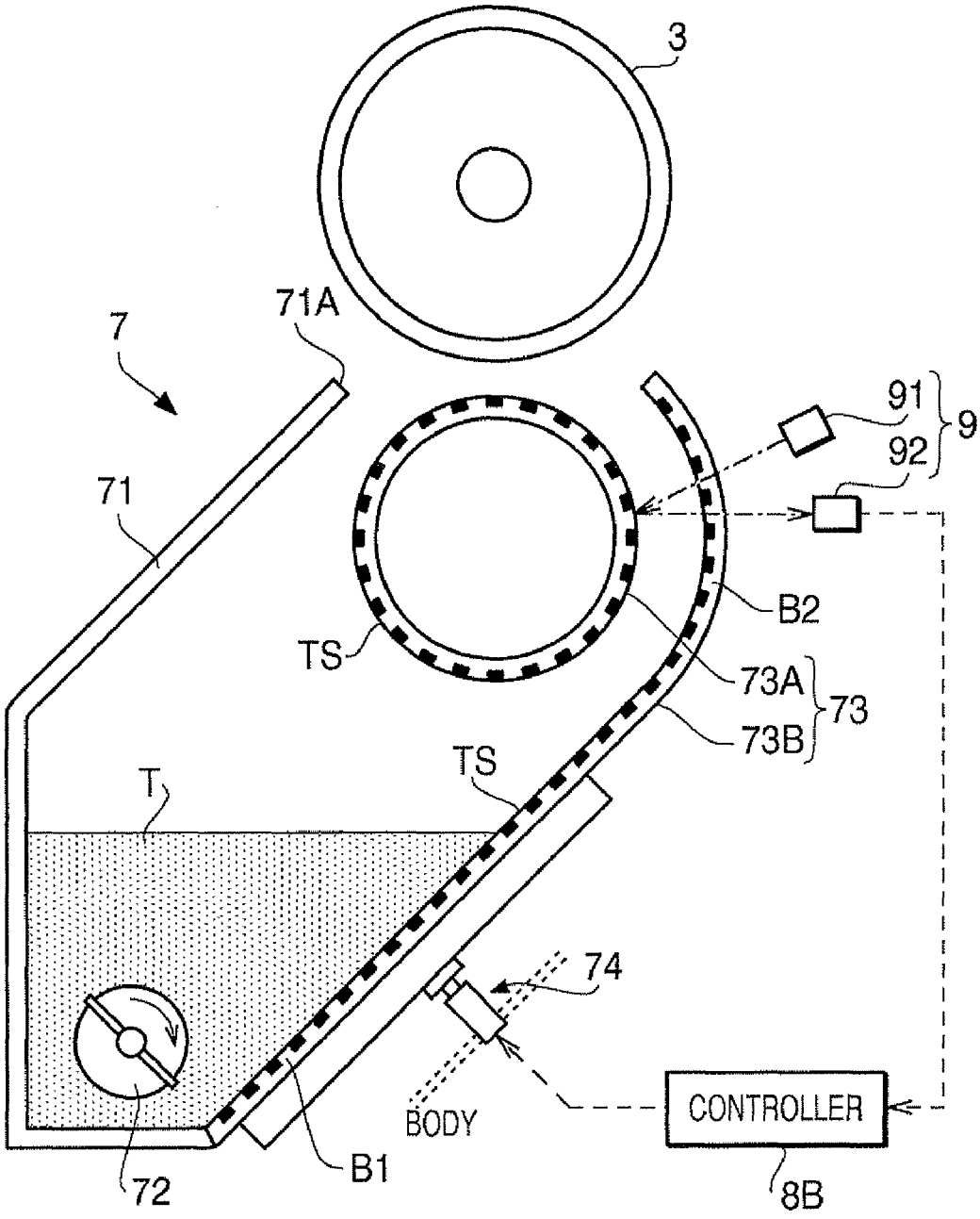
FIG. 10 is a cross section illustrating a toner supplying device and components provided around the toner supplying device in accordance with a second embodiment.

FIG. 10 is a cross section illustrating the toner supplying device 7 and components provided around the toner supplying device 7. As shown in FIG. 10, around the toner supplying device 7, a photosensor 9 for detecting the amount of toner T being carried in the toner supplying device 7 is provided. A controller 8B for controlling the vibrator 74 in accordance with a detection signal output by the photosensor 9 is also provided around the toner supplying device 7.

The photosensor 9 is located on the upstream side with respect to the supply opening 71A of the cartridge case 71. The photosensor 9 includes a light emission unit 91 which emits light toward the carrying surface TS of the first toner carrying unit 73A and a photoreceptor 92 which receives light reflected from the carrying surface TS of the first toner carrying unit 73A. In this embodiment, each of the support plate 731 and the coating 733 is made of transparent material.

In this configuration, the amount of light received by the photoreceptor 92 changes depending on the amount of toner T being carried between the first and second toner carrying units 73A and 73B. Therefore, the photosensor 9 is able to detect the amount of toner T being carried between the first and second toner carrying units 73A and 73B. The information concerning the light amount detected by the photoreceptor 92 is sent to the controller 8B.

Figure 11:
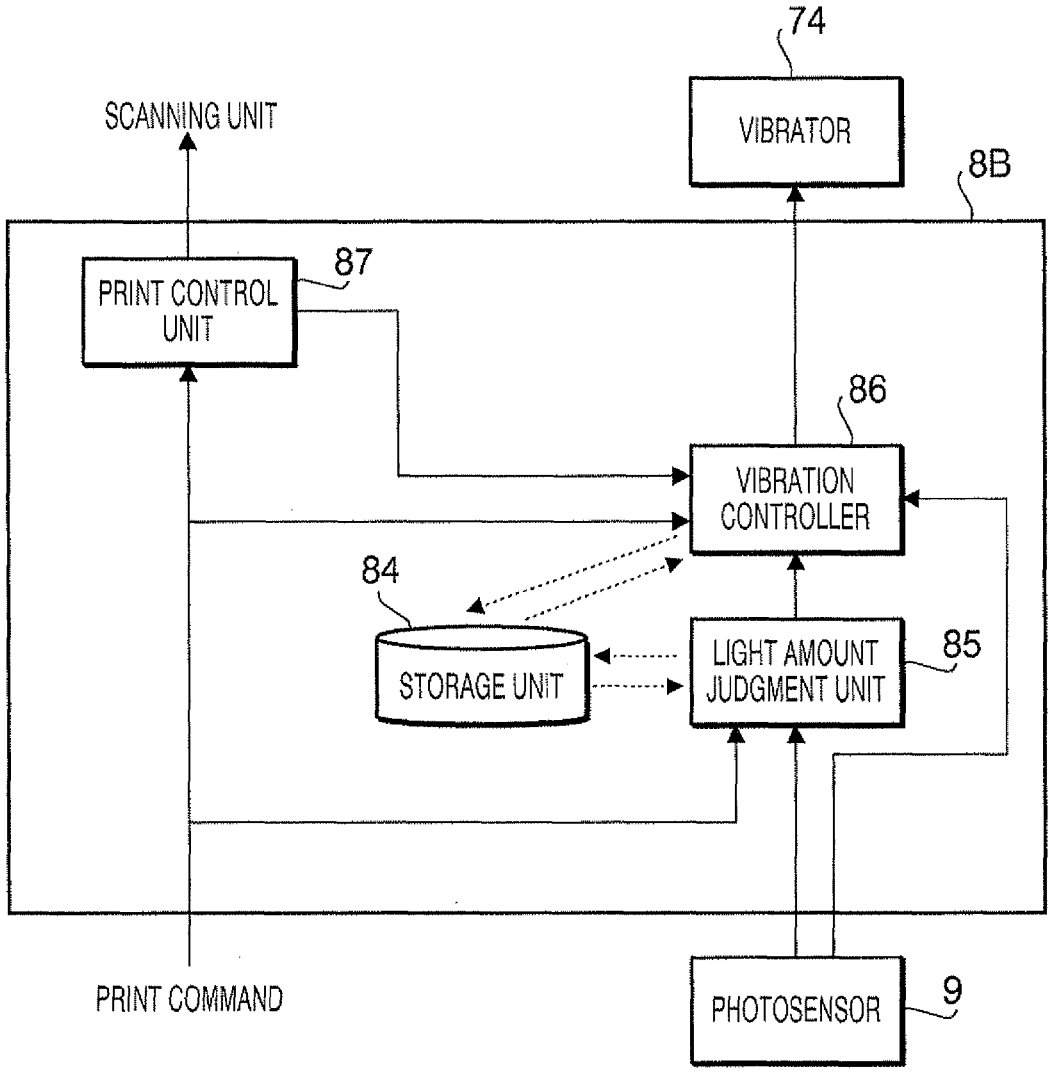
FIG. 11 is a block diagram of a controller according to the second embodiment.

FIG. 11 is a block diagram of the controller 8B. As shown in FIG. 11, the controller 8B includes a storage unit 84, a light amount judgment unit 85, a vibration controller 86 and a print control unit 87.

The storage unit 84 stores a predetermined value (light amount) used as a criterion for judging whether the amount of toner being carried is proper, information concerning the light amount detected by the photosensor 9, and an initial value of the vibration frequency for the vibrator 74.

When a print command is received from a user, the light amount judgment unit 85 obtains information concerning the light amount from the photosensor 9, and then judges whether the amount of toner T being carried is lower than or equal to a predetermined value by judging whether the light amount is larger than or equal to the predetermined value stored in the storage unit 84. That is, the light amount judgment unit 85 judges whether the amount of tone T being carried is in an abnormal state.

When the light amount judgment unit 85 judges that the amount of toner T being carried is lower than or equal to the predetermined value (i.e., when the light amount judgment unit 85 judges that the amount of toner T is in an abnormal state), the light amount judgment unit 85 sends an error signal representing that the amount of toner T is in an abnormal state to the vibration controller 86, and stores information concerning the obtained light amount in the storage unit 84. In this case, the information concerning the obtained light amount is stored in the storage unit 84 as a previous light amount. That is, historical data of the detected light amount is recorded.

On the other hand, when the light amount judgment unit 85 judges that the amount of toner T being carried is larger than the predetermined value (i.e., the amount of toner T being carried is in a normal state), the light amount judgment unit 85 sends no signal to the vibration controller 86.

The vibration controller 86 has a function of vibrating the vibrator 74 at a frequency equal to the initial value stored in the storage unit 84 when the vibration controller 86 receives the print command from the user. The vibration controller 86 has a function of tentatively increasing the vibration frequency of the vibrator 74 by a predetermined amount when the vibration controller 86 receives the error signal from the light amount judgment unit 85. That is, for the first time operation, the vibration controller 86 adopts, as a vibration changing mode of the vibration frequency, an increasing mode where the vibration frequency is increased.

Further, the vibration controller 86 has a function of judging whether the amount of toner T being carried has become larger than or equal to the immediately previous value of the detected toner amount, by judging whether the obtained light amount has become lower than or equal to the immediately previous value of the light amount stored in the storage unit 84. The newly obtained light amount is then stored in the storage unit 84 as an immediately previous value of the light amount.

When the vibration controller 86 judges that the amount of toner T being carried has become larger than or equal to the immediately previous value of the amount of toner T, the vibration controller 86 regards the increased vibration frequency as approaching an optimum vibration frequency for collapsing the toner T, and then further increases the vibration frequency to maintain the increasing mode. On the other hand, when the vibration controller 86 judges that the amount of toner T being carried has become lower than the immediately previous value of the amount of toner T, the vibration controller 86 regards the increased vibration frequency as moving away from the optimum vibration frequency for collapsing the toner T, and then switches the increasing mode to the decreasing mode to decrease the vibration frequency.

Subsequently, the vibration controller 86 obtains again the light amount from the photosensor 9 to repeat the above described operation. Consequently, the vibration frequency approaches the optimum frequency.

When the vibration frequency reaches the optimum frequency and thereby the amount of toner T being carried becomes larger than the predetermined value, the vibration controller 86 stops changing the vibration frequency. When the vibration controller 86 receives the print completion signal from the print control unit 87, the vibration controller 86 stops vibration of the vibrator 74.

The print control unit 87 has a function of starting the print operation when the print command is received from the user, and has a function of sending the print completion signal to the vibration controller 86 when the print operation is finished for the number of copies designated in the print command.

Figure 12:
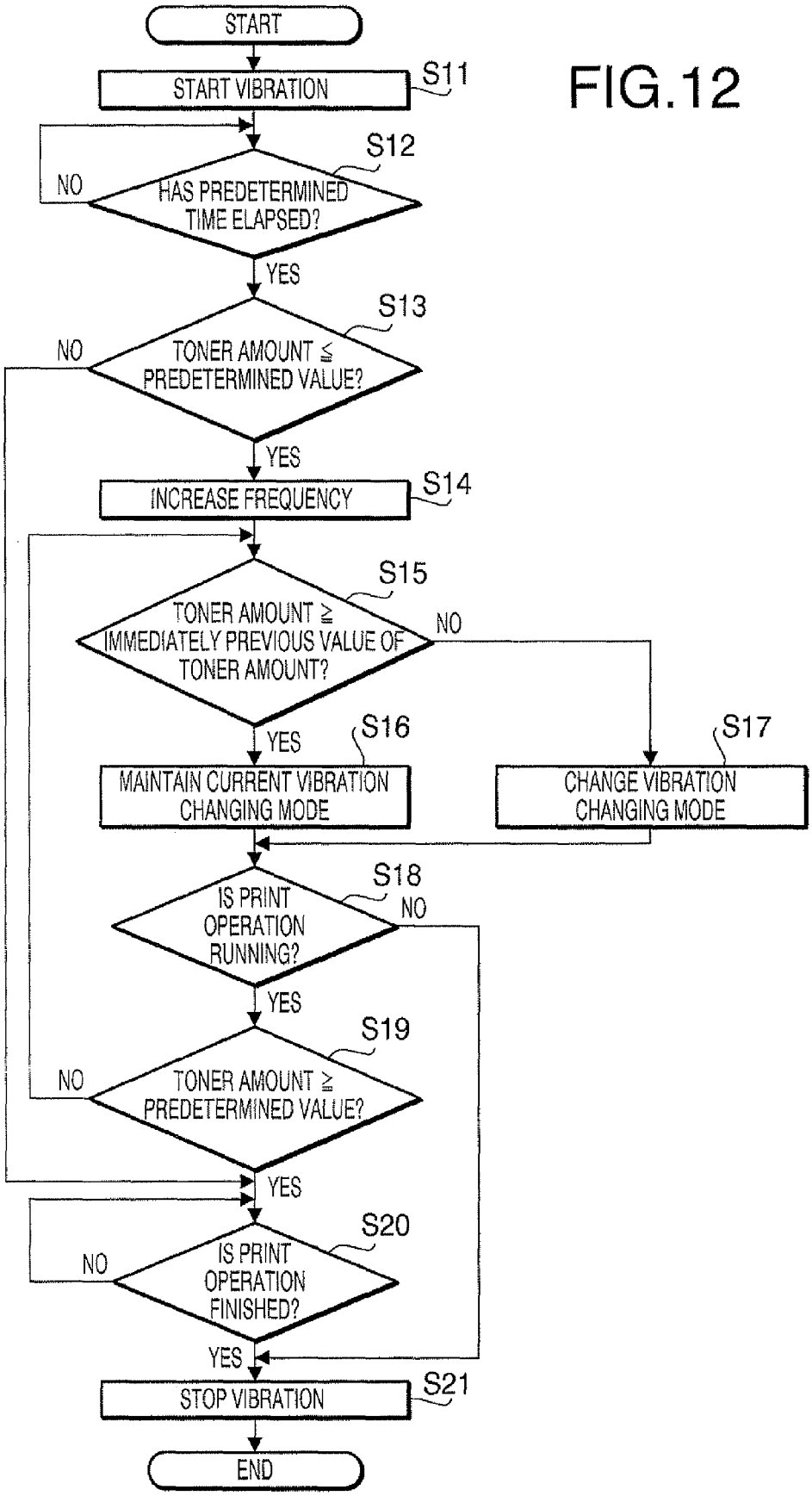
FIG. 12 is a flowchart illustrating a control process executed under control of the controller according to the second embodiment.

FIG. 12 is a flowchart illustrating a control process executed under control of the controller 8B according to the second embodiment. It should be noted that the print operation may be executed concurrently with the control process shown in FIG. 12 in response to the print command from the user.

As shown in FIG. 12, when the controller 8B receives the print command from the user, the controller 8B starts to vibrate the vibrator 74 at an initial frequency value (step S11). Then, the controller 8B judges whether the toner T has been carried to the position where the toner T can be detected by the photosensor 9, by judging whether a predetermined time has elapsed from the start of vibration (step S12).

If the controller 8B judges that the predetermined time has elapsed (S12: YES), the controller 8B judges whether the amount of toner T being carried is lower than or equal to the predetermined value (step S13). If the controller 8B judges that the amount of toner T being carried is lower than or equal to the predetermined value (S13: YES), the controller 8B increases the vibration frequency (step S14). That is, the controller 8B operates tentatively in the increasing mode.

Next, the controller 8B judges whether the vibration frequency approaches the optimum frequency for collapsing the toner T in the increasing mode, by judging whether the amount of toner T being carried is larger than or equal to the immediately previous value of the detected toner amount (step S15). If the controller 8B judges that the amount of toner T being carried is larger than or equal to the immediately previous value of the detected toner amount (S15: YES), control proceeds to step S16 where the controller 8B maintains the current vibration changing mode and changes the vibration frequency in accordance with the current vibration changing mode. On the other hand, if the controller 8B judges that the amount of toner T being carried is smaller than the immediately previous value of the detected toner amount (S15: NO), control proceeds to step S17 where the controller 8B switches the vibration changing mode and sets the vibration frequency in accordance with the switched vibration changing mode.

That is, regarding processes of steps S15 to S17, if the vibration changing mode which was adopted before step S15 is the increasing mode, the controller 8B maintains the increasing mode in step S16, but switches the vibration changing mode from the increasing mode to the decreasing mode in step S17.

If the vibration changing mode adopted before step S15 is the decreasing mode, the controller 8B maintains the decreasing mode in step S16, but switches the vibration changing mode from the decreasing mode to the increasing mode in step S17.

After step S16 or S17 is processed, the controller 8B judges whether the printing operation is running by judging whether the print completion signal is being output from the print control unit 87 to the vibration controller 86 (step S18). If the controller 8B judges that the print operation is running (S 18: YES), the controller 8B judges whether the amount of tone T being carried is larger than the predetermined value (step S19).

If the controller 8B judges that the amount of toner T is lower than or equal to the predetermined value (S19: NO), control returns to step S15. If the controller 8B judges that the amount of toner T exceeds the predetermined value in step S19 or S13 (S13: NO or S19: YES), control proceeds to step S20 where the controller 8B judges whether the print operation has finished by judging whether the print completion signal is asserted.

The controller 8B repeats step S20 until the print operation is finished (S20: NO). That is, in this case, the controller 8B maintains the current vibration frequency to continue to vibrate the vibrator 74 at the frequency set in immediately preceding execution of step S16 or S17 until the print operation is finished.

If the controller 8B judges that the print operation is finished in step S18 or S20 (S18: NO, S20: YES), the controller 8B stops vibrating the vibrator 74 (step S21). Then, the control process terminates.

As described above, the second embodiment is able to provide the following advantages in addition to achieving the substantially the same advantages attained by the first embodiment.

Since the vibration frequency is determined in accordance with the information concerning the amount of toner T detected by the photosensor 9, it is possible to determine the suitable vibration frequency depending on the actual amount of toner T being carried.

The photosensor 9 is located on the upstream side with respect to the supply opening 71A of the cartridge case 71. Such a configuration makes it possible to feed back the amount of toner T during execution of the print operation and thereby to change the vibration frequency to the optimum frequency in real time. Therefore, it is possible to properly carry the toner T during the print operation, and thereby to suitably form an image on a recording medium.

Third Embodiment

Hereafter, a laser beam printer according to a third embodiment is described. The laser beam printer according to the third embodiment is a variation of the laser beam printer 1 achieved by changing a partial structure of the toner supplying device 7 and components around the toner supplying device 7. Therefore, in FIGS. 13 and 14, to elements which are substantially the same as those of the first and second embodiment, the same reference numbers are assigned, and explanations thereof will not be repeated.

Figure 13:
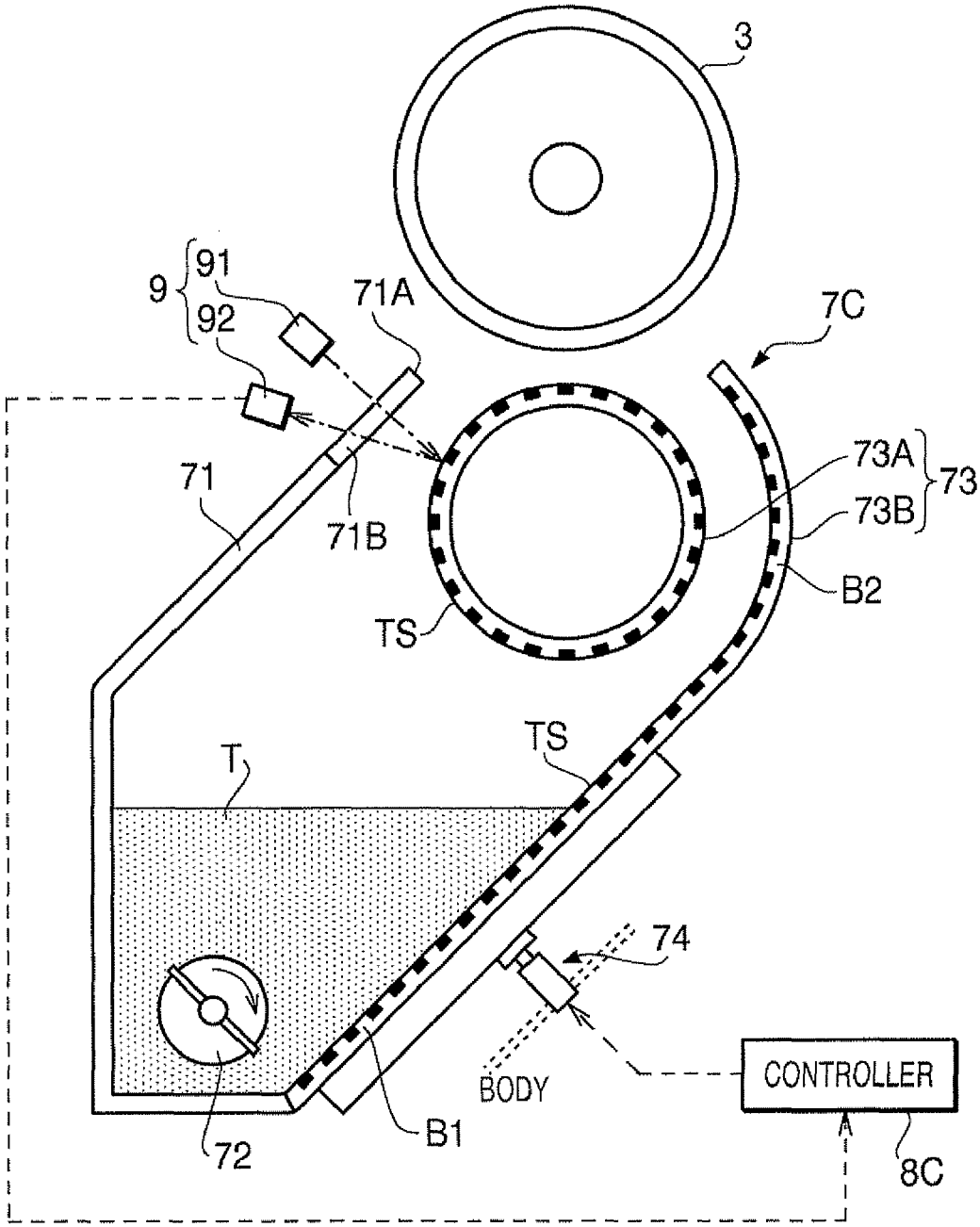
FIG. 13 is a cross section illustrating a toner supplying device and components provided around the toner supplying device in accordance with a third embodiment.

FIG. 13 is a cross section illustrating a toner supplying device 7C and components provided around the toner supplying device 7C. As shown in FIG. 13, a window part 71B is formed as a part of the supply opening 71A of the cartridge case 71. The window part 71A is made of transparent material, such as glass. In this embodiment, the photosensor 9 is situated on the downstream side with respect to the supply opening 71A. The photosensor 9 emits light toward the carrying surface TS of the first toner carrying unit 73A through the window part 71B. The amount of light detected by the photoreceptor 92 of the photosensor 9 is sent to a controller 8C.

The controller 8C has a function of controlling the toner carrying unit 73 to operate during a non-developing time and changing the vibration frequency of the vibrator 74 in accordance with a signal from the photosensor 9. The term "non-developing time" means a time zone when no print job is executed. In this embodiment, "non-developing time" corresponds to a time zone between issue of the print command and the start of the print operation.

Figure 14:
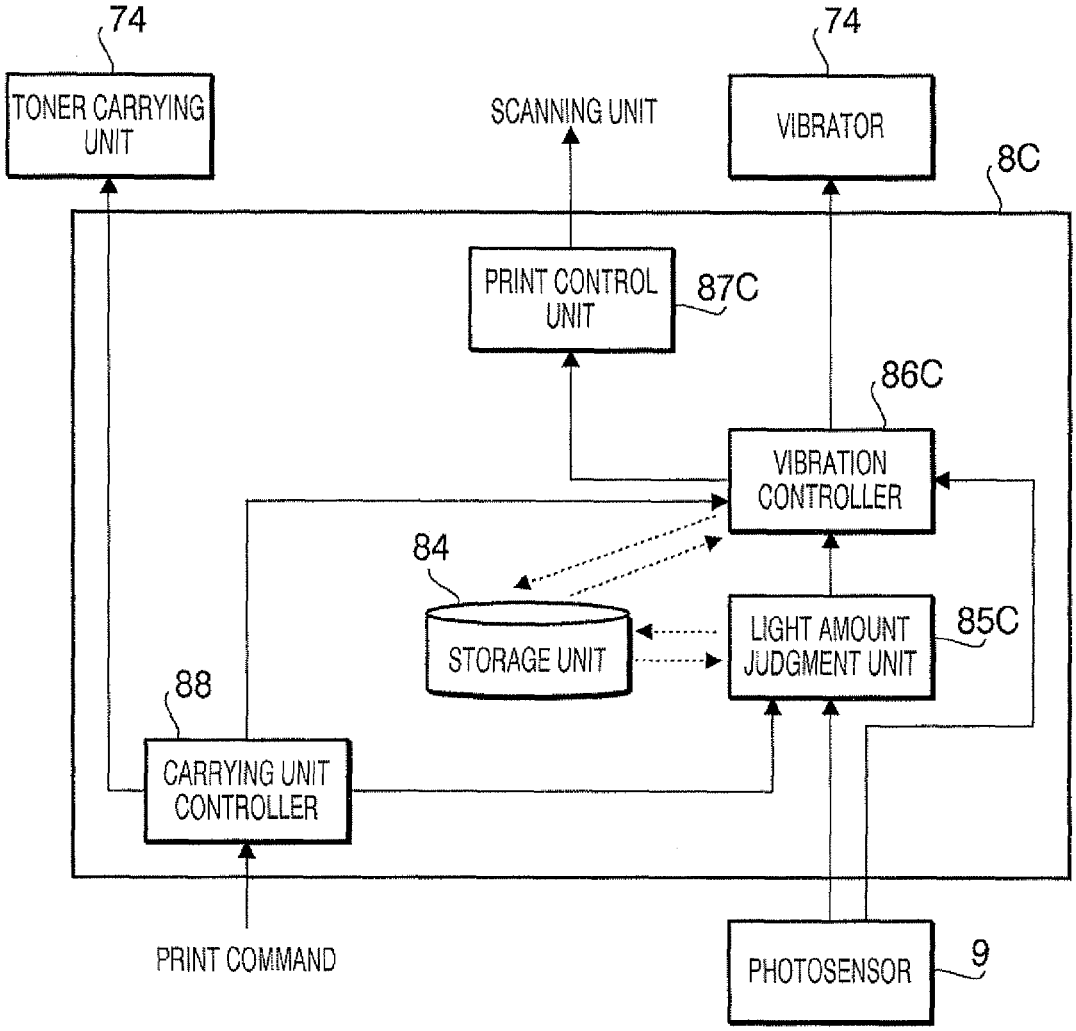
FIG. 14 is a block diagram of a controller according to the third embodiment.

FIG. 14 is a block diagram of the controller 8C. As shown in FIG. 14, the controller 8C includes the storage unit 84, a light amount judgment unit 85C, a vibration controller 86C, a print control unit 87C, and a carrying unit controller 88.

The carrying unit controller 88 has a function of activating the toner carrying unit 73 to start carrying the toner T when the carrying unit controller 88 receives a print command from a user. When the carrying unit controller 88 has activated the toner carrying unit 73, the carrying unit controller 88 sends an activation signal representing activation of the toner carrying unit 73 to the light amount judgment unit 85C and the vibration controller 86C.

The light amount judgment unit 85C has substantially the same function as that of the light amount judgment unit 85 according to the second embodiment. In the second embodiment, the light amount judgment unit 85 starts the control in response to receipt of the print command. By contrast, in this embodiment, the light amount judgment unit 85C starts the control in response to receipt of the activation signal from the carrying unit controller 88. Since the function of the light amount judgment unit 85C is substantially the same as that of the light amount judgment unit 85 according to the second embodiment, explanation thereof will not be repeated.

The vibration controller 86C has substantially the same function as that of the vibration controller 86 according to the second embodiment. The feature of the vibration controller 86C is that the vibration controller 86C outputs a print start signal to the print control unit 87C after the vibration frequency reaches the optimum frequency (i.e., the vibration frequency exceeds the predetermined value) and thereby the vibration controller 86C stops changing of the vibration frequency. Since the function of the vibration controller 86C is substantially the same as that of the vibration controller 86 according to the second embodiment, explanation thereof will not be repeated.

The print control unit 87C has substantially the same function as that of the print control unit 87 according to the second embodiment. In the second embodiment, the print control unit 87 starts the print operation in response to the print command from the user. By contrast, the print control unit 87C starts the print operation in response to the print start signal from the vibration controller 86C. Since in this embodiment the toner carrying unit 73 is activated by the carrying unit controller 88, the print control unit 87C executes the print operation by controlling the components other than the toner carrying unit 73 in the laser beam printer.

Figure 15:
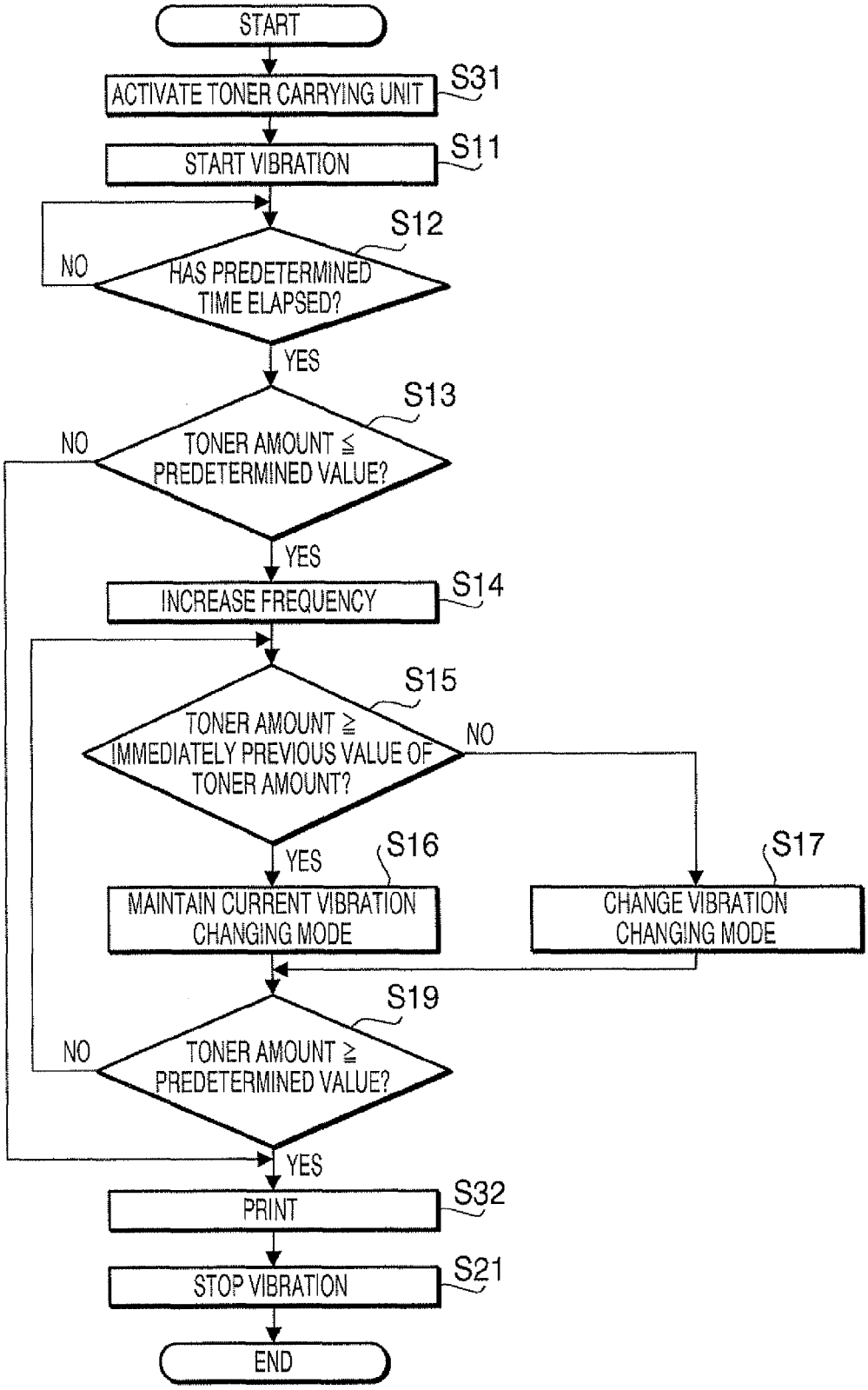
FIG. 15 is a flowchart illustrating a control process executed under control of the controller according to the third embodiment.

FIG. 15 is a flowchart illustrating a control process executed under control of the controller 8C. When the controller 8C receives a print command from a user, the controller 8C activates the toner carrying unit 73 to start carrying the toner T (step S31). Then, the controller 8C executes the same steps S11 to S19 as those executed in the control process according to the second embodiment (see FIG. 12).

In this embodiment, the print operation is started after the optimum vibration frequency is determined and thereby the agglutinated toner T is suitably collapsed. Therefore, in this embodiment, step S18 is omitted.

If the controller 8C judges that the amount of toner T exceeds the predetermined value in step S13 or S19 (S13: NO or S19: YES), i.e., if the toner T is being carried suitably, the controller 8C stops changing of the vibration frequency to maintain the currently set frequency by avoiding control from retuning to step S15. Then, the controller 8C executes the print operation (step S32). After the print process is finished, the controller 8C stops vibrating the vibrator 74 (step S21). Then, the control process shown in FIG. 15 terminates.

According to the third embodiment, the following advantages are achieved. In this embodiment, before start of the print operation, the toner carrying unit 73 is activated, and the vibration frequency is changed to the optimum vibration frequency to collapse the agglutinated toner T. Therefore, it is possible to carry the suitable amount of toner T to the photosensitive drum 3 during the print operation. Consequently, it is possible to appropriately form an image on a recording medium.

Although the present invention has been described in considerable detail with reference to certain preferred embodiments thereof, other embodiments are possible.

Figure 16:
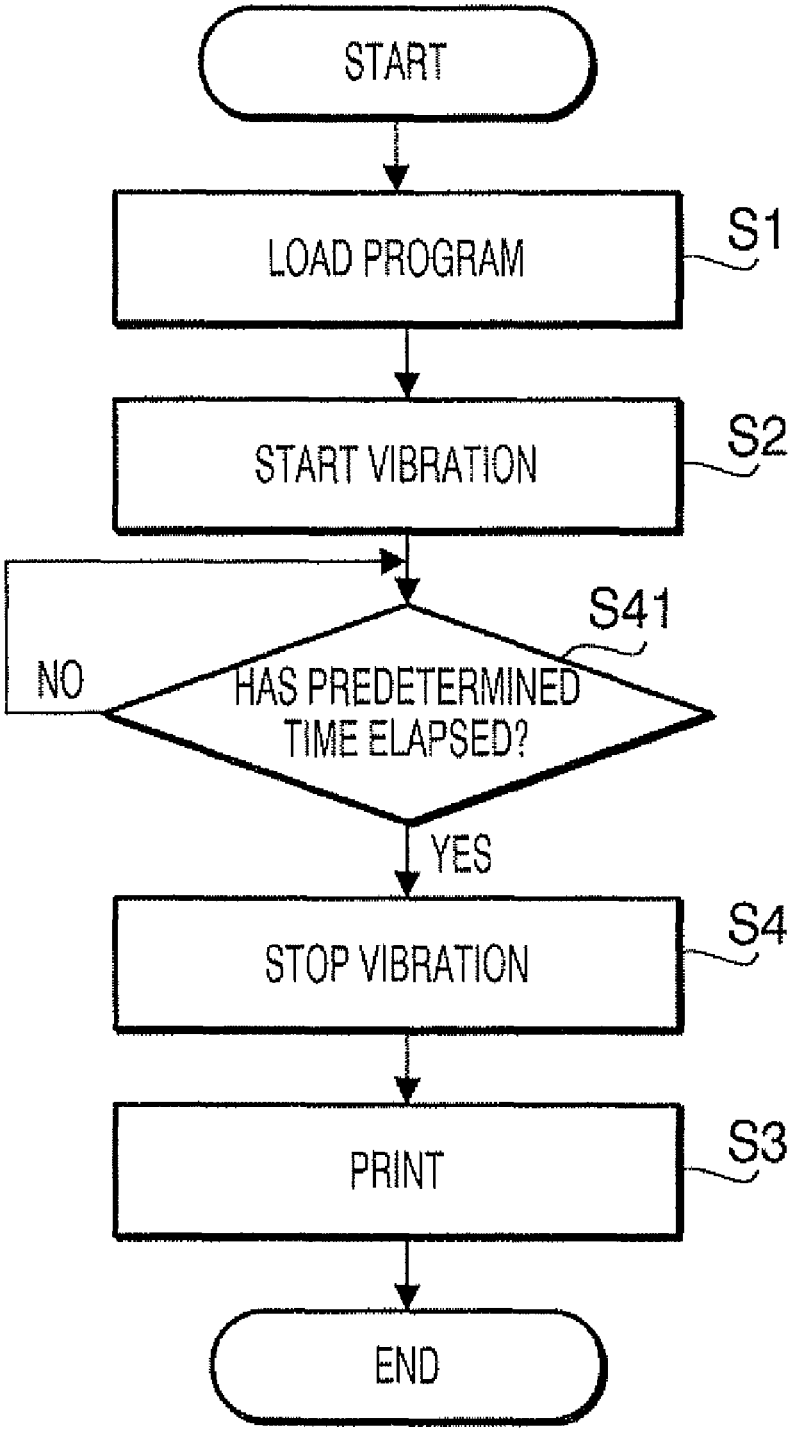
FIG. 16 is a flowchart illustrating a control process in which the vibration frequency is changed before execution of a print operation.

In the first embodiment, the vibration frequency is changed while the toner T is carried. However, the vibration frequency may be changed before start of carrying of the toner T. Such a variation can be achieved by suitably changing the flowchart of the control process shown in FIG. 9 as shown in FIG. 16. That is, the control process shown in FIG. 16 is achieved by moving the step S4 for stopping the vibration to the position before the step S3 for the print operation and by adding a judgment process (step S41) for judging whether a predetermined time has elapsed between steps S2 and S4.

With this configuration, it is possible to change the vibration frequency up and down and thereby to collapse the toner T before execution of the print operation. Consequently, it is possible to appropriately carry the toner T during the print operation.

In the third embodiment, the time zone between receipt of the print command and start of the print operation is adopted as the non-developing time. However, various types of time zones may be adopted as the non-developing time. For example, a time zone corresponding to a predetermined time period from power on of the laser beam printer 1, a predetermined time period from termination of the print operation caused by an abnormal state (e.g., occurrence of a situation where temperature or humidity exceeds a predetermined value), or a predetermined time period from the time when the number of printed sheets of paper reaches a predetermined number.

In the third embodiment, the photosensor 9 is located on the downstream side with respect to the supply opening 71A, the photosensor 9 may be located on the upstream side with respect to the supply opening 7A.

In the second or third embodiment, the controller 8B (or 8C) tentatively adopts the increasing mode in step S14 to search for the optimum vibration frequency. However, the controller 8B (or 8C) may tentatively adopt the decreasing mode to search for the optimum vibration frequency.

In the second or third embodiment, the photosensor 9 which detects the amount of light reflected from the first toner carrying unit 73A is adopted as a detection unit for detecting the amount of toner being carried. However, various types of detection units for detecting the amount of tone being carried may be adopted in the laser beam printer 1. For example, a density sensing unit including a camera which captures images of the toner T being carried and an image processing unit which processes the images captured by the camera may be adopted as a detection unit for detecting the amount of toner being carried. By detecting the density of toner T, the amount of toner T being carried can be detected.

In the above described embodiment, the vibrator 74 is configured such that the core 74C is fixed to a body of the laser beam printer 1, while the coil 74B is provided to be movable with respect to the core 74C. However, the vibrator 74 may be configured such that the coil 74B is fixed to the body of the laser beam printer 1, while the core 74C is provided to be movable with respect to the coil 74B.

In the above described embodiment, a vibrator formed as combination of a coil and a core is adopted. However, various types of vibrating members, such as a piezoelectric element, may be adopted as the vibrator 74.

In the above described embodiment, a member to be vibrated by the vibrator 74 (i.e., the second toner carrying unit 73B) is formed as a part of the cartridge case 71. However, a member to be vibrated by the vibrator 74 may be placed in the inside of the cartridge case 71.

In the above described embodiments, the control process for the changing the vibration frequency is implemented on the laser beam printer 1. However, the control process may be implemented on various types of image forming devices, such as a copying device or a multifunction peripheral.

In the above described embodiments, a photosensitive drum is adopted as an image holding unit. However, a photosensitive member having a form of a belt may be adopted as n image holding unit.

In the above described embodiments, the toner T having a negative electrostatic property is adopted as developing material. However, toner having a positive electrostatic property (i.e., toner charged positively) may be adopted as developing material. In this case, the internal components to be charged including the photosensitive drum 3 are charged inversely.

In the above described embodiment, the vibration frequency is controlled to change periodically as illustrated in FIG. 8. However, control of the vibration frequency may be executed such that the vibration frequency takes randomly changing values.

What is claimed is:

1. An image forming device, comprising:

an image holding unit configured to hold an image formed by developing material;

a developing material case configured to accommodate the developing material and to have a supplying opening facing the image holding unit;

a carrying unit having a plurality of carrying electrodes, the carrying unit being configured to carry the developing material accommodated in the developing material case toward the image holding unit by generating a traveling electric field through the plurality of carrying electrodes;

a vibrator that vibrates the carrying unit; and a controller that controls the vibrator to change a frequency of vibration, the controller being configured to continuously change the frequency of vibration up and down within a predetermined frequency range in a form of a successive sine wave.

2. The image forming device according to claim 1, wherein the predetermined frequency range is a range of 50 to 1000 Hz.

3. The image forming device according to claim 1, wherein the predetermined frequency range is a range of 100 to 500 Hz.

4. The image forming device according to claim 1, wherein the controller changes the frequency of vibration up and down within the predetermined frequency range while the developing material is carried by the carrying unit.

5. An image forming device, comprising:

an image holding unit configured to hold an image formed by developing material;

a developing material ease configured to accommodate the developing material and to have a supplying opening facing the image holding unit;

a carrying unit having a plurality of carrying electrodes, the carrying unit being configured to carry the developing material accommodated in the developing material case toward the image holding unit by generating a traveling electric field through the plurality of carrying electrodes;

a vibrator that vibrates the carrying unit;

a controller that controls the vibrator to change a frequency of vibration; and a detection unit configured to detect an amount of the developing material being carried by the carrying unit, wherein the controller determines the frequency of vibration based on the amount of the developing material detected by the detection unit.

6. The image forming device according to claim 5, wherein:

the detection unit is located on an upstream side with respect to the supplying opening of the developing material case; and the controller determines the frequency of vibration based on the amount of the developing material detected by the detection unit during a developing time when supplying of the developing material to the image holding unit is executed.

7. The image forming device according to claim 5, wherein, during a non-developing time when supplying of the developing material to the image holding unit is stopped, the controller activates the carrying unit and determines the frequency of vibration based on the amount of the developing material detected by the detection unit.

8. The image forming device according to claim 5, wherein the controller continuously changes the frequency of vibration.

9. The image forming device according to claim 5, wherein the controller changes the frequency of vibration such that the frequency of vibration changes periodically.

* * * * *